US006658714B2

(12) United States Patent
Mei et al.

(10) Patent No.: US 6,658,714 B2
(45) Date of Patent: Dec. 9, 2003

(54) COMPLIANT CLAMPING MECHANISM FOR ACCURATE ALIGNMENT OF A GROUP OF MINIATURE PARTS

(75) Inventors: Youping Mei, Eden Prairie, MN (US); Lance Eugene Stover, Eden Prairie, MN (US); Jianxin Zhu, Eagan, MN (US)

(73) Assignee: Seagate Technology LLC, Scotts Valley, CA (US)

( * ) Notice: Subject to any disclaimer, the term of this patent is extended or adjusted under 35 U.S.C. 154(b) by 0 days.

(21) Appl. No.: 09/975,489

(22) Filed: Oct. 10, 2001

(65) Prior Publication Data

US 2002/0066170 A1 Jun. 6, 2002

Related U.S. Application Data

(60) Provisional application No. 60/238,921, filed on Oct. 10, 2000.

(51) Int. Cl.[7] ..... B25B 27/14

(52) U.S. Cl. ..... 29/281.5; 29/281.1; 254/254 CS

(58) Field of Search ..... 29/281.1, 281.5; 269/6, 3, 254 CS, 289 R

(56) References Cited

U.S. PATENT DOCUMENTS

| | | | | | |
|---|---|---|---|---|---|
| 641,703 | A | * | 1/1900 | Kizler | 269/6 |
| 4,134,144 | A | | 1/1979 | Ragle et al. | 360/133 |
| 4,417,289 | A | | 11/1983 | Ragle et al. | 360/98 |
| 4,456,938 | A | | 6/1984 | Baasch et al. | 360/109 |
| 4,458,274 | A | | 7/1984 | Charlson et al. | 360/75 |
| 4,592,541 | A | | 6/1986 | Huray | 269/155 |
| 5,267,106 | A | | 11/1993 | Brue et al. | 360/98.08 |
| 5,590,004 | A | | 12/1996 | Boutaghou | 360/99.12 |
| 5,987,735 | A | | 11/1999 | Horning et al. | 29/737 |
| 5,992,837 | A | | 11/1999 | Groves | 269/258 |
| 6,088,226 | A | | 7/2000 | Rearick | 361/704 |
| 6,104,116 | A | | 8/2000 | Fuller et al. | 310/217 |
| 6,279,885 | B1 | * | 8/2001 | Leon, Jr. | 269/8 |
| 6,434,807 | B1 | * | 8/2002 | Begin | 29/227 |

* cited by examiner

*Primary Examiner*—Lee D. Wilson

(57) ABSTRACT

A clamping apparatus for holding elements includes a first spring member and a second spring member. The first spring member has a rigid portion that applies the majority of force to the elements. The second spring member is attached to the first spring member. The second spring member is more flexible than the first spring member. The second spring member has a structure that accommodates dimensional variations in elements held by the clamping member.

24 Claims, 5 Drawing Sheets

COMPLIANT CLAMPING MECHANISM FOR ACCURATE ALIGNMENT OF A GROUP OF MINIATURE PARTS

RELATED APPLICATION

This application claims the benefit of U.S. Provisional Application Ser. No. 60/238,921, filed Oct. 10, 2000 under 35 U.S.C. 119(e).

FIELD OF THE INVENTION

The present invention relates to the field of mass storage devices. More particularly, this invention relates to a compliant clamping mechanism for accurate alignment of a group of miniature parts, such as processing of bars of a strip of heads for a disc drive.

BACKGROUND OF THE INVENTION

One key component of any computer system is a device to store data. Computer systems have many different places where data can be stored. One common place for storing massive amounts of data in a computer system is on a disc drive. The most basic parts of a disc drive are a disc for storing data. The disc includes a magnetic layer. A transducer is passed over the surface of the disc and is used to either magnetize the magnetic layer of the disc or to detect magnetized portions of the disc. The transducer is typically housed within a small ceramic block known as a slider. The transducer is attached to an actuator. The actuator moves the slider and the transducer within the slider to various locations over the disc where information representing data is written to or retrieved from the disc surface.

The process of forming individual sliders starts with forming multiple transducers on a surface of a ceramic wafer using semiconductor fabrication techniques. After forming the transducers on the wafer, the wafer is then sliced or cut to form an elongated bar having a row of transducers (a rowbar). The rowbars are elongated pieces of ceramic that are fragile. The rowbars undergo many manufacturing processes and must be held firmly. The holder for the rowbars must be able to accommodate slight variations in dimension and hold the rowbar firmly throughout these various processing steps. The processing steps include various steps for removing material including lapping to provide a first "rough approximation" removal of material and milling for removing material at a slower, more controlled rate than the lapping process. An air-bearing surface is also formed on the rowbars before being diced into individual sliders.

In the past, mechanical clamping fixtures for holding small, fragile parts have been designed to hold single parts. Some clamping fixtures hold multiple small parts but generally these clamps have several problems. One rather large problem associated with clamps for holding multiple parts is that not all the parts are adequately secured due to variations in individual part dimensions. A clamping mechanism for holding small parts has limited space. Due to the limited space, there is little room for fitting a complicated apparatus to securely hold multiple small parts. Furthermore, even if a complicated apparatus can securely hold multiple parts, the more complicated an apparatus is the more difficult the apparatus is to use. Complicated apparatus are also generally more time consuming and costly to produce.

As a result, there is a need for a simple clamp that produces an appropriate amount of force to hold multiple small parts. Clamping multiple parts simultaneously is particularly difficult due to variations in individual part dimensions. Thus, there is also a need for a compliant clamping structure that is capable of accommodating size differences in several small or miniature parts and that is self-adjusting so that these parts may be continued to be held as they undergo multiple processing steps. There is also a need for a spring structure that can hold small parts reliably without yielding or plastically deforming. The clamping mechanism must also be capable of enduring the environments associated with the processes that the small or miniature parts undergo during manufacture. Due to their small and varying size, very small or miniature parts are difficult to hold in place for further processing, particularly, when multiple miniature parts need to be held in a limited space. In summary, there is a need for a clamping mechanism that simultaneously secures multiple miniature parts in a limited space that has a reduced cost.

SUMMARY OF THE INVENTION

A clamping apparatus for holding elements includes a first spring member and a second spring member. The first spring member has a rigid portion that applies the majority of force to the elements. The second spring member is attached to the first spring member. The second spring member is more flexible than the first spring member. The second spring member has a structure that accommodates dimensional variations in elements held by the clamping member.

A clamping apparatus for holding elements includes a first spring member. The first spring member includes a rigid portion that applies the majority of force to the elements. The clamping apparatus includes a second spring member. The second spring member is attached to the first spring member. The second spring member is more flexible than the first spring member. The second spring member accommodates dimensional variations in the elements held by the clamping member. The second spring member includes a plurality of flexible structures for holding elements. The first spring element surrounds the second spring member. The first spring element has a notch therein. The first spring element has an opening for handling the spring. The first spring element has at least one slit therein. The dimension of the at least one slit determines the spring force produced by the first spring element. The first spring element may also have a plurality of slits therein. In this case, the plurality of slits determine the spring force produced by the first spring element.

The first spring element is rectangular. The second spring element is attached to one side of the rectangle of the first spring element. The second spring element includes a plurality of elongated openings for holding a plurality of elongated elements. The second spring element includes a plurality of elongated bars for contacting a plurality of elements. The second spring element may include a plurality of elongated bars for contacting a plurality of elements. At least one of the elongated bars includes a rounded feature or at least two rounded features for contacting an element.

A method for clamping elements includes the steps of holding at least one element with at least one flexible bar, and attaching the flexible bar to a rigid frame. The one flexible bar and a portion of the rigid frame hold the element. The rigid frame produces a majority of the force for holding the at least one element. The flexible bar is dimensioned to accommodate variations in dimensions associated with the one element. One or more slits may be placed in the rigid frame to adjust the amount of force applied to clamp the element. A second flexible bar may be added to hold a second element. The second flexible bar is spaced away from the first flexible bar so as to accommodate the dimension of a second element. The first flexible bar contacts a first element on one side and a second element on the other side.

These and various other features as well as advantages that characterize the present invention will be apparent upon reading of the following detailed description and review of the associated drawings.

DESCRIPTION OF THE PREFERRED EMBODIMENT

In the following detailed description of the preferred embodiments, reference is made to the accompanying drawings that form a part hereof, and in which are shown by way of illustration specific embodiments in which the invention may be practiced. It is to be understood that other embodiments may be utilized and structural changes may be made without departing from the scope of the present invention.

The invention described in this application is useful with all mechanical configurations of disc drives having either rotary or linear actuation. In addition, the invention is also useful in all types of disc drives including hard disc drives, zip drives, floppy disc drives and any other type of drives where unloading the transducer from a surface and parking the transducer may be desirable.

Figure 1:
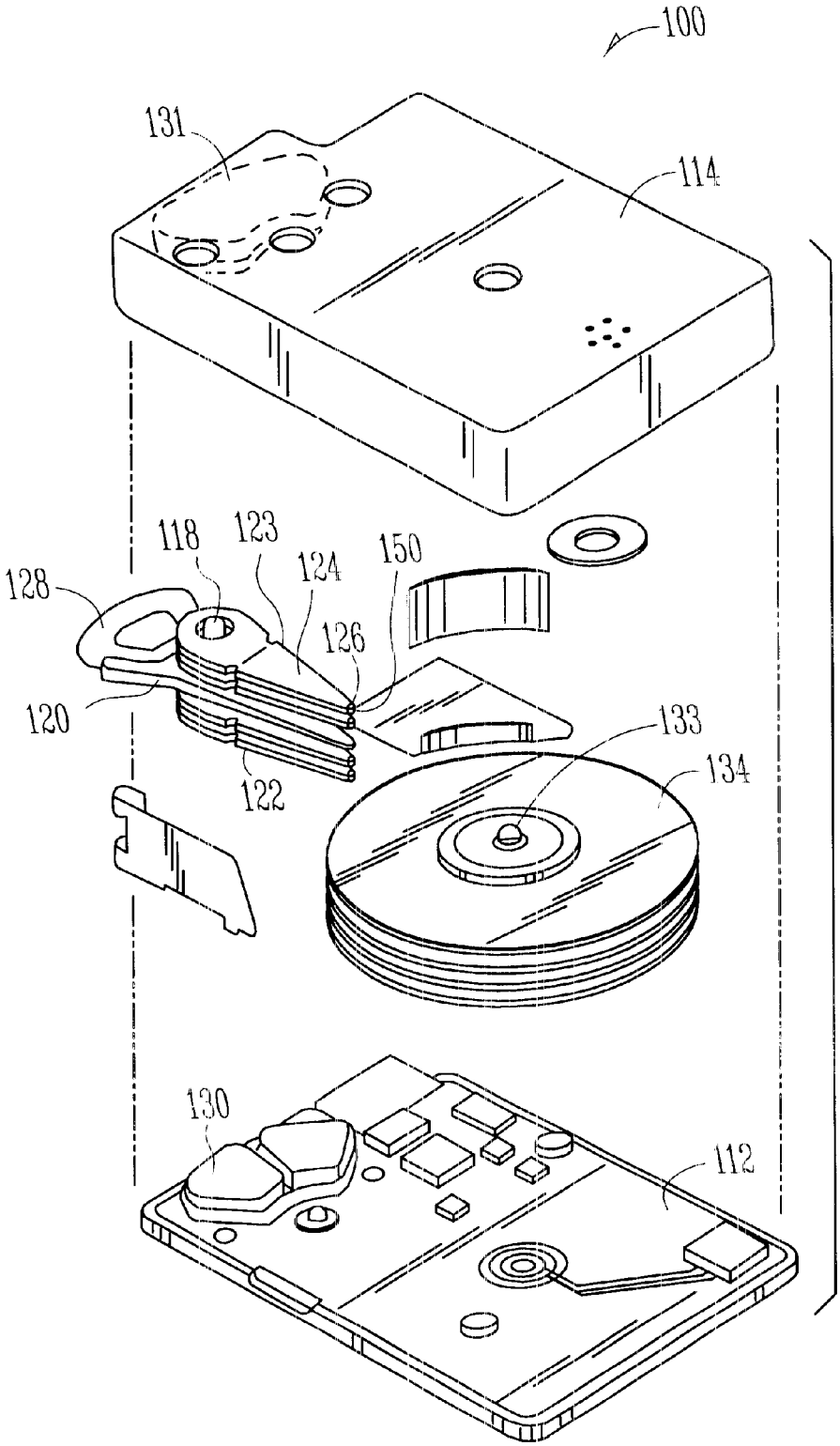
FIG. 1 is an exploded view of a disc drive with a multiple disc stack and a ramp assembly for loading and unloading transducers to and from the surfaces of the discs.

FIG. 1 is an exploded view of one type of a disc drive 100 having a rotary actuator. The disc drive 100 includes a housing or base 112, and a cover 114. The base 112 and cover 114 form a disc enclosure. Rotatably attached to the base 112 on an actuator shaft 118 is an actuator assembly 120. The actuator assembly 120 includes a comb-like structure 122 having a plurality of arms 123. Attached to the separate arms 123 on the comb 122, are load beams or load springs 124. Load beams or load springs are also referred to as suspensions. Attached at the end of each load spring 124 is a slider 126 that carries a magnetic transducer 150. The slider 126 with the transducer 150 form what is many times called the head. It should be noted that many sliders have one transducer 150 and that is what is shown in the figures. It should also be noted that this invention is equally applicable to sliders having more than one transducer, such as what is referred to as an MR or magneto resistive head in which one transducer 150 is generally used for reading and another is generally used for writing. On the end of the actuator arm assembly 120 opposite the load springs 124 and the sliders 126 is a voice coil 128.

Attached within the base 112 is a first magnet 130 and a second magnet 131. As shown in FIG. 1, the second magnet 131 is associated with the cover 114. The first and second magnets 130, 131 and the voice coil 128 are the key components of a voice coil motor that applies a force to the actuator assembly 120 to rotate it about the actuator shaft 118. Also mounted to the base 112 is a spindle motor. The spindle motor includes a rotating portion called the spindle hub 133. In this particular disc drive, the spindle motor is within the hub. In FIG. 1, a number of discs 134 are attached to the spindle hub 133. In other disc drives a single disc or a different number of discs may be attached to the hub. The invention described herein is equally applicable to disc drives that have a plurality of discs as well as disc drives that have a single disc. The invention described herein is also equally applicable to disc drives with spindle motors that are within the hub 133 or under the hub.

Figure 2:
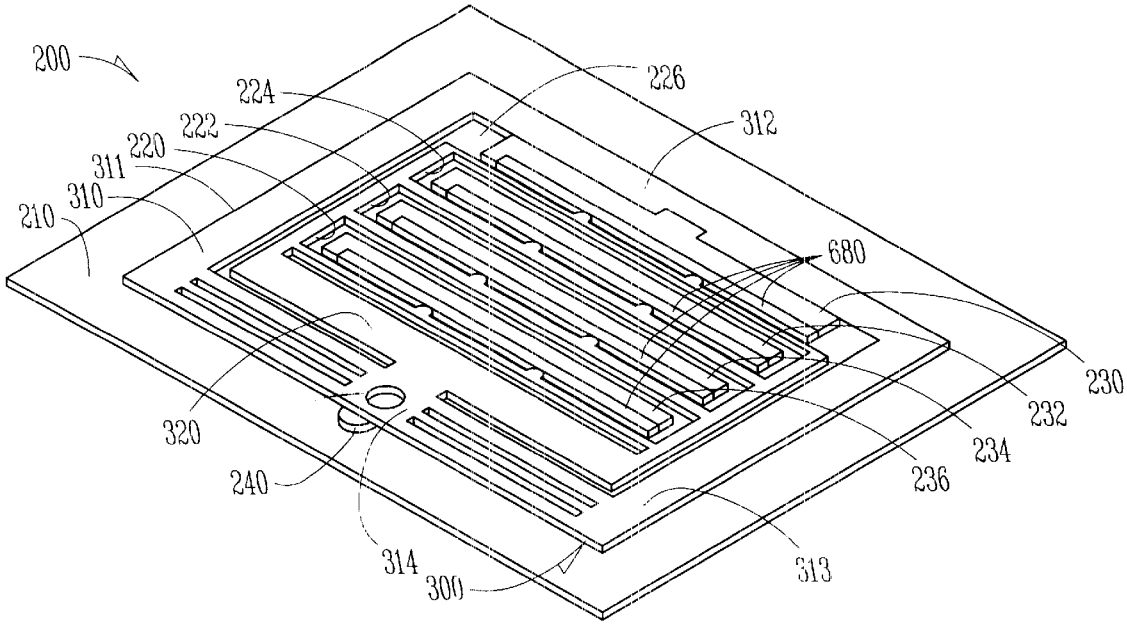
FIG. 2 is a perspective view of an embodiment of a compliant clamping assembly of the present invention.

As shown in FIG. 2, an embodiment of the present invention includes a compliant clamping mechanism assembly 200. The clamping assembly 200 has a base 210 and a two-stage spring 300. The base 210 includes openings 220, 222, 224, 226. Each opening 220, 222, 224, 226 includes a standoff 230, 232, 234 and 236 that holds one side of element 680 (see FIG. 6). The standoff and element are collectively called the part. The standoffs are alignment features. One standoff 230 engages a notch 315 of the two-stage spring 300 in order to provide the counterforce to the spring as it is pulled out. The other standoffs 232–236 are attached to the base, just like the first standoff 230, and provide a surface to engage an element 680, such as a rowbar. The base 210 also includes an oblong or circular protrusion 240 that is a peg over which the corresponding opening 340 in the two-stage spring 300 can be placed when stretched. The two-stage spring 300 includes a first stage 310 and a second stage 320. Throughout the specification the term "first stage" is interchangeable with the terms "first-stage spring", "first-stage spring element" and "rigid portion." Also, the term "second stage" is interchangeable with the terms "second-stage spring", "second-stage spring element" and "flexible portion."The first stage 310 of the two-stage spring 300 includes a first leg 311, a second leg 312, a third leg 313, and a fourth leg 314. The first stage 310 is a rectangular frame that is attached along leg 312 to the base 210. The base 210 includes a protrusion attached to the base 210.

Figure 3:
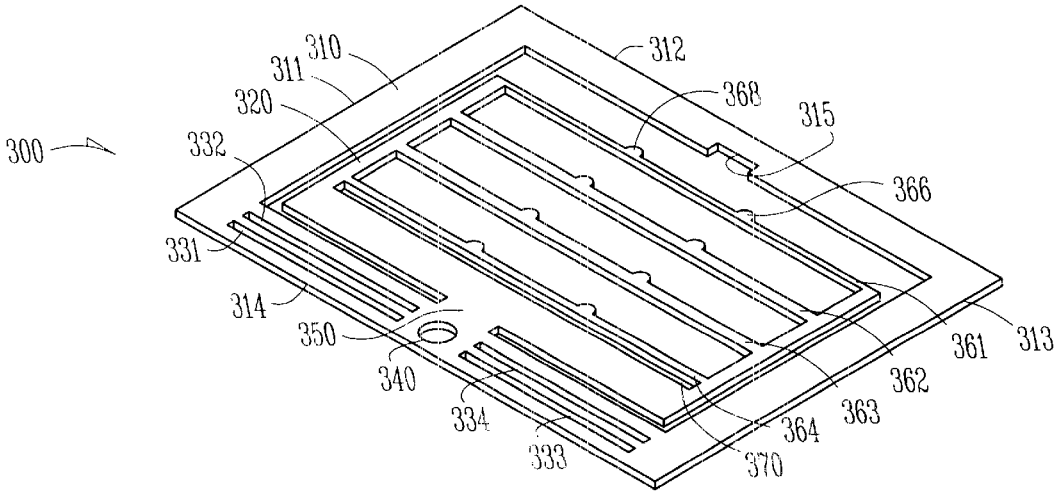
FIG. 3 is a perspective view of the two-stage spring structure of the compliant clamping assembly of FIG. 2.
Figure 4:
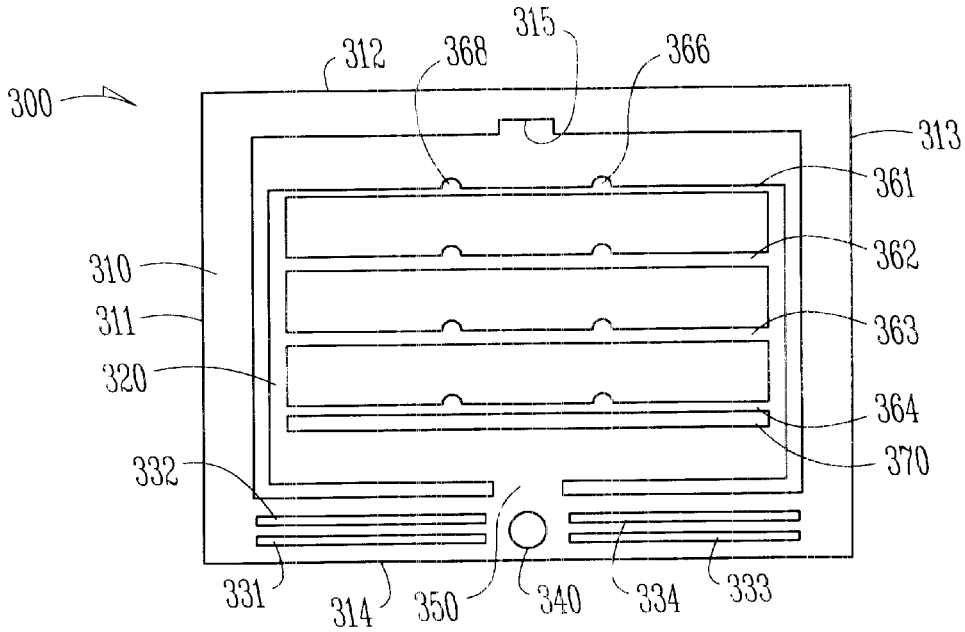
FIG. 4 is a top view of the two-stage spring structure of the compliant clamping assembly of FIG. 2.

FIG. 3 is a perspective view of the two-stage spring structure 300 of the compliant clamping assembly 200 of FIG. 2. FIG. 4 is a top view of the two-stage spring structure of the compliant clamping assembly of FIG. 2. As shown in FIGS. 3 and 4, leg 312 of the first stage includes a notch 315. The notch accommodates irregularities in the dimensions of the elements to be held by the two-stage spring structure 300. In addition, before loading the bars the notch 315 is aligned with the base 210. There is an interface between the standoff surface 236 and the arm 312 that provides an interface between the first stage 310 of the two-stage spring 300 and the base 210 (see FIG. 2). The fourth leg 314 of the first stage 310 includes the handling opening 340. Also included in the fourth leg 314 are a number of slits 331, 332, 333, 334. The slits are elongated and are dimensioned to produce an exact force on the second-stage spring 320. The first stage 310 is connected to the second stage 320 by a bar 350 between the fourth leg 314 of the first stage 310 and the second-stage spring element 320. The second-stage spring element 320 is also substantially rectangular in shape and fits within the inner boundaries of the first spring element 310. In other words, the second-stage spring element 320 fits inside the legs 311, 312, 313, 314 of the first stage 310 of the two-stage spring element 300.

Still referring to FIGS. 3 and 4, the second stage 320 is also rectangular in shape. The outer dimensions of the rectangle of the second-stage spring 320 produce a narrow gap between the first-stage spring 310 and the second-stage spring 320 on the three of the four sides of the second-stage spring 320. The rectangular shape of the second-stage spring 320 falls significantly short of the second arm 312 of the first-stage spring 310. The spacing between the second arm 312 of the first-stage spring 310 and the edge of the second-stage spring element 320 provides for a gap capable of holding an element between the arm 312 of the first stage and the second-stage spring element 320. The second-stage spring element includes four flexible beams 361, 362, 363, 364. The flexible beam 361 is along the edge of the second-stage spring 320 that is closest to the second arm 312 of the first-stage spring 310. Each of the flexible beams 361, 362, 363, 364 are designed so that they are flexible enough to avoid plastic deformation yet rigid enough to deliver sufficient clamping force to each of the elements that are clamped by the two-stage spring assembly 300. The flexible beams 361, 362, 363, 364 are also flexible enough to accommodate variations in the dimensions of the elements to be held by the two-stage spring assembly 300. Each flexible beam, such as 361, includes a first rounded shoulder 366 and a second rounded shoulder 368. The rounded shoulders 366, 368 contact the element to be clamped along its links. The rounded feature provides for accommodating slight differences in dimension since the rounded feature can essentially contact the element to be held along a line or point. The rounded element also floats or moves slightly with respect to the element to be held. The spacing between flexible beams 361 and 362, and the spacing between flexible beams 362 and 363, and the spacing between flexible beams 363 and 364 are all approximately equal or substantially equal. Spacing between the flexible arms 361, 362, 363, and 364 is very close to one of the dimensions of an element to be held between these flexible beams 361, 362, 363, 364. In addition, the spacing between flexible beam 361 and the second arm 312 of the first-stage spring 310 is also close to a dimension of the element or elements to be held by the two-stage spring structure 300. In addition, the second-stage spring 320 includes a slit 370. The slit 370 provides for flexible arm 364.

Figure 5:
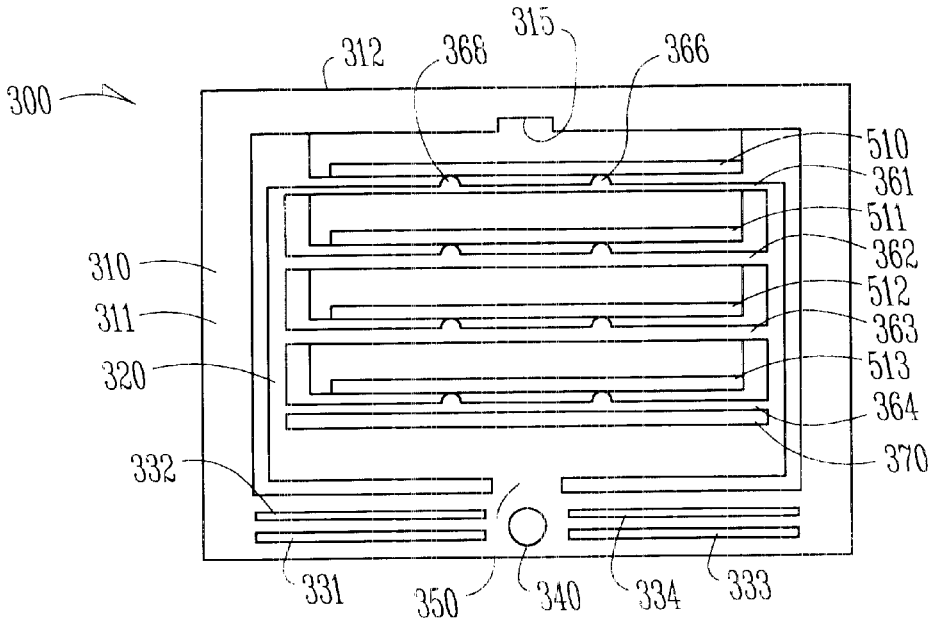
FIG. 5 is a top view of the two-stage spring structure of the compliant clamping assembly holding a plurality of rowbars.

FIG. 5 is a top view of the two-stage spring structure 300 of the compliant clamping assembly 200 holding a plurality of row bars 510, 511, 512, and 513. In operation, the first-stage spring 310 provides the total force to be applied to individual elements held by the flexible beams 361, 362, 363, 364. In other words, the first-stage spring 310 is attached to the base. The base 210 provides a reaction force or reactive force. The first stage spring 310 is elongated slightly via the handling hole 340 and elements are placed between arm 312 of the first-stage 310 spring and flexible arm 361 of the second-stage spring 320 as well as in the openings between the flexible beams 361, 362, 363, 364. By releasing or moving the first-stage spring 310 to a contracted position, each of the flexible beams 361, 362, 363, 364 engages one side of the element and the second arm 312 of the first-stage spring 310 as well as a flat side of each of the flexible beams 361, 362, 363 engage the other side of each of the elements. The first stage 310 of the two-stage spring 300 provide the majority of the spring force for holding the various element while the flexible beams 361, 362, 363, 364 are stiff enough to deliver the force to the elements held by the two-stage spring and yet flexible enough to accommodate dimensional variation in each of the elements.

The elements 510, 511, 512, 513 held by the two-stage spring need not necessarily be rowbars. The two-stage spring and the openings between the flexible beams 361, 362, 363, 364 and the opening between the first stage and flexible beam 361 can be dimensioned to hold any type of element. It should be noted that in order to work, the elements need to be inserted within the second stage so that the total force produced by the first stage is placed on all four elements 510, 511, 512, 513. It is also worthy of note that the elements 510, 511, 512, 513 held in the two-stage spring structure 300 are very fragile pieces of ceramic in this particular application. Thus, the two-stage spring structure 300 is capable of holding a fragile element 510, 511, 512, 513 with an adequate amount of force so that various operations may be conducted upon the elements 510, 511, 512, 513.

Figure 6:
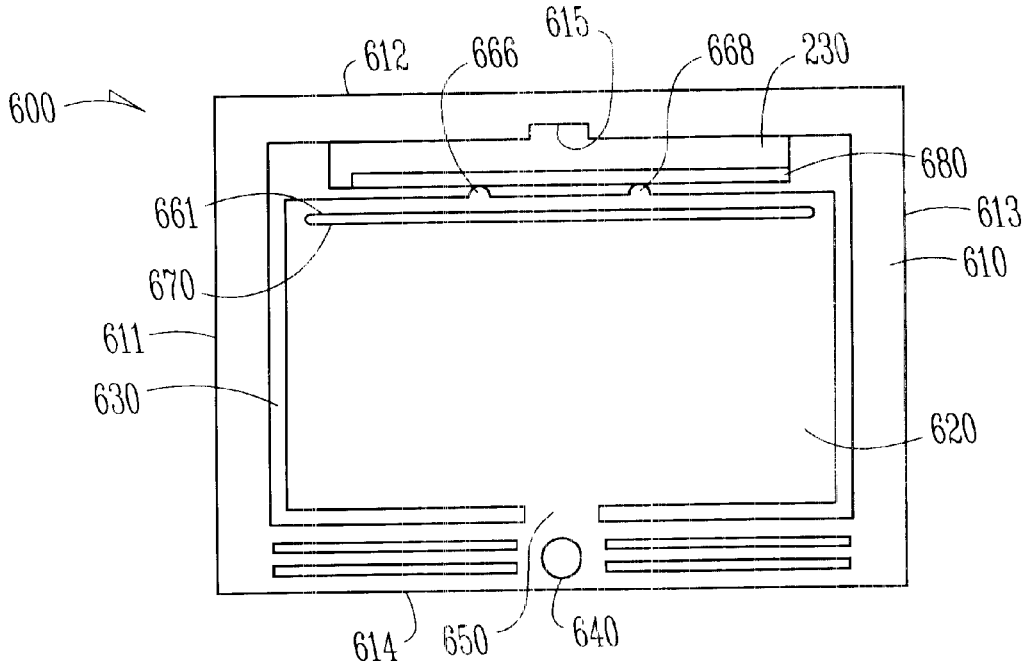
FIG. 6 is a top view of an embodiment of a two-state spring structure of the present invention wherein the flexible portion has one flexible arm that holds a single rowbar.

FIG. 6 is a top view of an embodiment of a two-stage spring structure 600. The two-stage spring structure includes a first stage 610 and a second stage 620. The first stage 610 includes a first arm 611, a second arm 612, a third arm 613, and a fourth arm 614. The second arm 612 includes a notch 615. The first stage 610 is substantially rectangular in shape and has a rectangular opening 630 therein. The rectangular opening is between the arms or legs 611, 612, 613, 614 of the first stage 610 of the two-stage spring structure 600. The second-stage spring structure includes a single flexible beam 661. The second-stage spring structure is essentially a thin metal piece that includes a slit 670 near the flexible beam 661. The second-stage spring 620 is attached to the first-stage spring structure 610 via arm 650.

Figure 7:
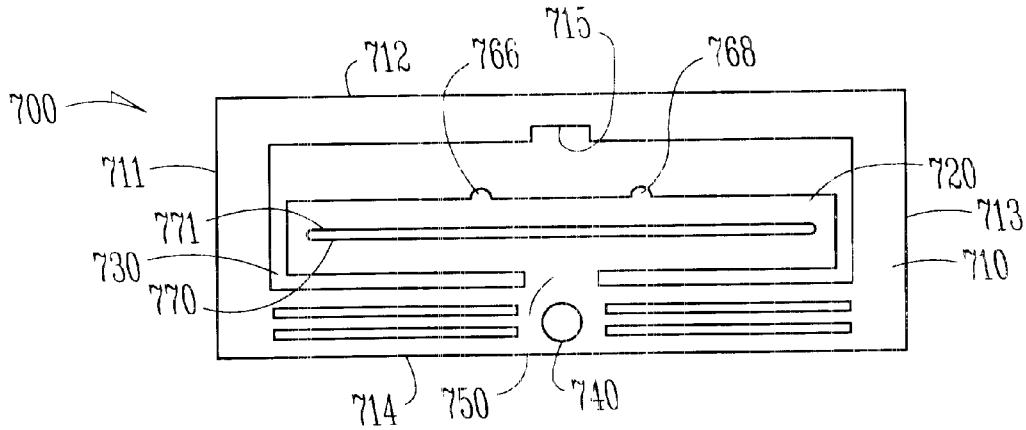
FIG. 7 is a top view of another embodiment of a two-state spring structure of the present invention wherein the flexible portion has one flexible arm that holds a single rowbar.

The flexible beam 661 includes rounded shoulder portions 666 and 668. In operation, the spring is elongated after the spring is attached to the base by moving the spring using the handling opening 640. And element 680 is placed into the opening between the flexible arm 661 and the second leg 612 of the first stage 610. Moving the pin in the handling opening or releasing the pin produces a spring force by the first-stage spring element 610. The second leg 612 of the first-stage spring structure holds the element 680 on one edge while the flexible arm 661 and, more specifically, the rounded shoulders 666 and 668 contact the element 680 on the other side. The flexible arm 661 and the rounded shoulders on 666, 668 on the flexible beam 661 accommodate slight dimensional variations between different elements 680 when they are held by the two-stage spring structure 600. Now that FIG. 7 is a top view of an embodiment of a two-stage spring structure 700. The two-stage spring structure includes a first stage 710 and a second stage 720. The first stage 710 includes a first arm 711, a second arm 712, a third arm 713, and a fourth arm 714. The second arm 712 includes a notch 715. The first stage 710 is substantially rectangular in shape and has a rectangular opening 730 therein. The rectangular opening is between the arms or legs 711, 712, 713, 714 of the first stage 710 of the two-stage spring structure 700. The second-stage spring structure includes a single flexible beam 761. The second-stage spring structure is essentially a thin metal piece that includes a slit 770 near the flexible beam 761. The second-stage spring 720 is attached to the first-stage spring structure 710 via arm 750. The flexible beam 761 includes rounded shoulder portions 766 and 768. The two-stage spring structure shown in FIG. 7 differs from the two-stage spring element shown in FIG. 6 in that the second-stage spring structure 720 has a smaller dimension than the second-stage spring structure 620.

Again referring to FIG. 7, in operation, the spring is elongated after the spring is attached to the base by moving the spring using the handling opening 740. And element 780 is placed into the opening between the flexible arm 761 and the second leg 712 of the first stage 710. Moving the pin in the handling opening or releasing the pin produces a spring force by the first-stage spring element 710. The second leg 712 of the first-stage spring structure holds the an element (not shown) on one edge while the flexible arm 761 and, more specifically, the rounded shoulders 766, 768, contact the element 780 on the other side. The flexible arm 761 and the rounded shoulders on 766, 768 on the flexible beam 761 accommodate slight dimensional variations between the different elements (not shown) when they are held by the two-stage spring structure 700.

Figure 8:
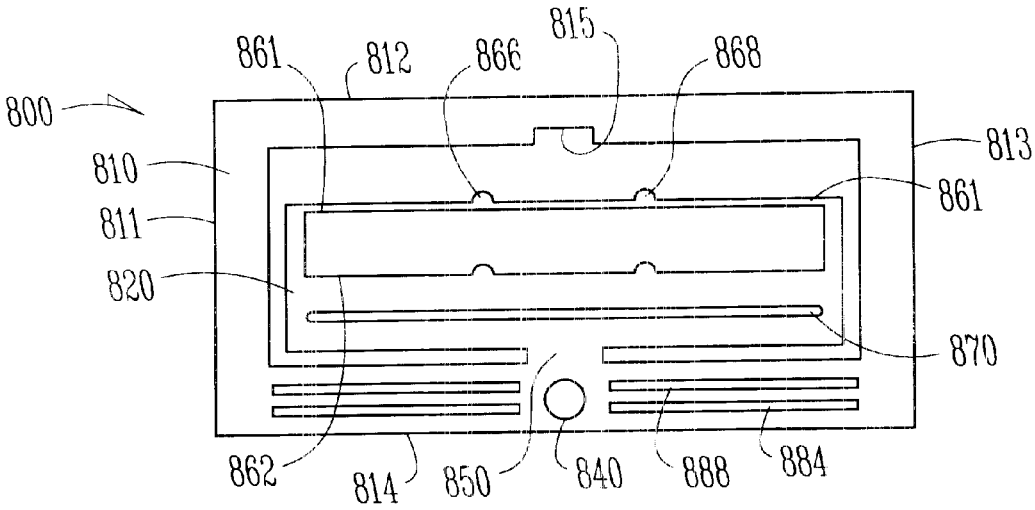
FIG. 8 is a top view of another embodiment of a two-state spring structure of the present invention wherein the flexible portion has a plurality of flexible arms that hold a plurality of rowbars.

FIG. 8 is a top view of an embodiment of a two-stage spring structure 800. The two-stage spring structure includes a first stage 810 and a second stage 820. The first stage 810 includes a first arm 811, a second arm 812, a third arm 813, and a fourth arm 814. The second arm 812 includes a notch 815. The first stage 810 is substantially rectangular in shape and has a rectangular opening 830 therein. The rectangular opening is between the arms or legs 811, 812, 813, 814 of the first stage 810 of the two-stage spring structure 800. The second-stage spring structure includes a first flexible beam 861 and a second flexible beam 862. The second-stage spring structure 820 is essentially a thin metal piece that includes a slit 870 near the flexible beam 862. The second-stage spring 820 is attached to the first-stage spring structure 810 via arm 850. Flexible beams 861, 862 includes rounded shoulder portions 866 and 868. The rounded shoulders on beam 862 have not been numbered for the sake of clarity. In operation, the spring is elongated after the spring is attached to the base by moving the spring using the handling opening 840. An element (not shown) is placed into the opening between the flexible beam 861 and the second leg 812 of the first stage 810. Another element (not shown) is placed between the flexible beam 861 and the flexible beam 862. Moving the pin in the handling opening releases the pin to produce a spring force by the first-stage spring element 810. The second leg 812 of the first-stage spring structure holds one element on one edge while the flexible arm 861 and, more specifically, the rounded shoulders 866, 868, contact the element on the other side. The flexible arm 861 and the rounded shoulders on 866, 868 on the flexible beam 861 accommodate slight dimensional variations between different elements 880 when they are held by the two-stage spring structure 800. The spring force produced by the first stage portion 810 also holds another element between the flexible beam 861 and the flexible beam 862. The two-stage spring structure shown in FIG. 8 differs from other spring structures because it holds a different number of elements. It should be noted that the number of elements held is not determinative of the invention. A two-stage spring capable of holding any number of elements is within the scope of this invention.

Conclusion

A clamping apparatus for holding elements includes a first spring member. The first spring member includes a rigid portion that applies the majority of force to the elements. The clamping apparatus includes a second spring member. The second spring member is attached to the first spring member. The second spring member is more flexible than the first spring member. The second spring member accommodates dimensional variations in the elements held by the clamping member. The second spring member includes a plurality of flexible structures for holding elements. The first spring element surrounds the second spring member. The first spring element has a notch therein. The first spring element has an opening for handling the spring. The first spring element has at least one slit therein. The dimension of the at least one slit determines the spring force produced by the first spring element. The first spring element may also have a plurality of slits therein. In this case, the plurality of slits determine the spring force produced by the first spring element. The first spring element is rectangular. The second spring element is attached to one side of the rectangle of the first spring element. The second spring element includes a plurality of elongated openings for holding a plurality of elongated elements. The second spring element includes a plurality of elongated bars for contacting a plurality of elements. The second spring element may include a plurality of elongated bars for contacting a plurality of elements. At least one of the elongated bars includes a rounded feature or at least two rounded features for contacting an element.

A method for clamping elements includes the steps of holding at least one element with at least one flexible bar, and attaching the flexible bar to a rigid frame. The one flexible bar and a portion of the rigid frame hold the element. The rigid frame produces a majority of the force for holding the at least one element. The flexible bar is dimensioned to accommodate variations in dimensions associated with the one element. One or more slits may be placed in the rigid frame to adjust the amount of force applied to clamp the element. A second flexible bar may be added to hold a second element. The second flexible bar is spaced away from the first flexible bar so as to accommodate the dimension of a second element. The first flexible bar contacts a first element on one side and a second element on the other side.

A clamping apparatus includes a flexible portion for holding an element and accommodating differences in dimension of the element, and a rigid device attached to the flexible portion. The rigid device produces a force to hold the element. The flexible element is an elongated bar spaced from the rigid device. The rigid device is a rectangular frame having a first opening therein. The first opening is dimensioned to surround the flexible member. The rigid device also includes a connecting portion for connecting the flexible member to the rigid frame, and a second opening formed by spacing the flexible member from the rigid frame. The flexible member includes a third opening on the other side of the flexible member. The rigid device includes at least one slit therein, the dimensions of the slit being varied to vary the amount of force applied by the rigid means. In the alternative, the rigid member may have multiple slits therein.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A clamping apparatus for holding elements comprising:

a first stage spring, the first stage spring including a rigid portion that applies the majority of force to a second stage spring within the first stage spring;

the second stage spring attached to the first stage spring and being more flexible than the first stage spring , the second stage spring having a plurality of flexible structures to physically hold the plurality of parts.

2. The clamping apparatus of claim 1 wherein the first stage spring surrounds the second spring member.

3. The clamping apparatus of claim 1 wherein the first stage spring has a notch therein.

4. The clamping apparatus of claim 1 wherein the first stare spring has portions defining an opening and the second state spring is positioned in the opening of the first stage spring.

5. The clamping apparatus of claim 1 wherein the first stage spring has at least one slit therein, the dimension of the at least one slit determining the spring force produced by the first state spring.

6. The clamping apparatus of claim 1 wherein the first stage spring has a plurality of slits therein, the plurality of slits determining the spring force produced by the first stage spring.

7. The clamping apparatus of claim 1 wherein the first stare spring is rectangular, the second stare spring attached to one side of the rectangle of the first stage spring.

8. The clamping apparatus of claim 1 wherein the plurality of flexible structures are comprised of a material that is flexible enough to not plastically deformable, yet rigid enough to deliver enough clamping force to the plurality of parts.

9. The clamping apparatus of claim 8 wherein the plurality of parts are a plurality of rowbars.

10. The clamping apparatus of claim 8 wherein the plurality of flexible structures includes at least one elongated bar, the at least one elongated bar including at least one rounded feature for contacting part.

11. The clamping apparatus of claim 8 wherein the plurality of flexible structures includes a plurality of elongated bars for contacting the plurality of parts, at least one of the plurality of elongated bars contacting a first part on one side and contacting a second part on the other side, wherein one sides of the the at least one of the plurality of elongated bars including at least two rounded features for contacting one of the first element or the second element.

12. A clamping apparatus comprising:

a flexible portion for holding a part and accommodating differences in dimension of the part; and a rigid portion, wherein the rigid portion has a substantially rectangular frame and a first opening therein, the first opening dimensioned to surround the flexible portion, a connecting portion for connecting the flexible member to the rigid portion, and a second opening formed by spacing the flexible member from the rigid frame.

13. The clamping apparatus of claim 12 wherein the flexible portion includes an elongated bar spaced from the rigid portion.

14. The clamping member of claim 13 wherein the flexible portion includes a third opening on the other side of the flexible portion.

15. The clamping apparatus of claim 12 wherein the rigid portion includes at least one slit therein, the dimensions of the slit being varied to vary the amount of force applied by the rigid portion.

16. The clamping apparatus of claim 12 wherein the rigid portion includes a, plurality of slits therein, the dimensions of the plurality of slits being varied to vary the amount of force applied by the rigid portion.

17. A clamping apparatus for holding an element comprising:

a first stage spring having at least one portion defining an opening;

a second stage spring connected to the first stage spring, wherein the second stage spring comprises a plurality of interconnected flexible beams structured to hold a plurality of parts.

18. The clamping apparatus of claim 17, wherein the plurality of interconnected flexible beams each have at least one rounded element.

19. The clamping apparatus of claim 17, wherein the second stage spring is positioned within the opening of the first stage spring.

20. The clamping apparatus of claim 17, wherein the plurality of parts each having varying dimensions.

21. The clamping apparatus of claim 17, wherein the second stage spring is comprised of a material that is flexible enough to not plastically deformable, yet rigid enough to deliver enough clamping force to the plurality of parts.

22. The clamping apparatus of claim 17, wherein the first stage spring is substantially rectangular in shape.

23. The clamping apparatus of claim 17, wherein the plurality of interconnected flexible beams comprises a plurality of substantially rectangular shaped structures, wherein at least one of the plurality of substantially rectangular shaped structures has at least one portion defining an opening.

24. The clamping apparatus of claim 17 wherein the first stage spring includes a plurality of slits therein, the dimensions of the plurality of slits being varied to vary the amount of force applied by the first stage spring.

* * * * *

UNITED STATES PATENT AND TRADEMARK OFFICE

CERTIFICATE OF CORRECTION

PATENT NO. : 6,658,714 B2
DATED : December 9, 2003
INVENTOR(S) : Mei et al.

It is certified that error appears in the above-identified patent and that said Letters Patent is hereby corrected as shown below:

Column 9,
Line 2, please change “the” to -- a --
Lines 8 and 20, (two occurrences on line 20), please change “stare” to -- stage --
Lines 9 and 14, please change “state” to -- stage --
Line 24, please change “deformable” to -- deform --
Line 32, please change “contacting part” to -- contacting the plurality of parts --
Line 39, please change “including” to -- include --

Column 10,
Line 13, please change “a, plurality” to -- a plurality --
Line 20, please change “connected to” to -- positioned within --
Line 35, please change “deformable” to -- deform --

Signed and Sealed this

Twenty-fifth Day of May, 2004

JON W. DUDAS
*Acting Director of the United States Patent and Trademark Office*